United States Patent [19]

Koisuka et al.

[11] Patent Number: 4,676,304

[45] Date of Patent: Jun. 30, 1987

[54] SERPENTINE-TYPE HEAT EXCHANGER HAVING FIN PLATES WITH LOUVERS

[75] Inventors: Mikio Koisuka; Hisao Aoki, both of Gunma, Japan

[73] Assignee: Sanden Corporation, Gunma, Japan

[21] Appl. No.: 690,773

[22] Filed: Jan. 14, 1985

[51] Int. Cl.[4] ..... F28F 13/06; F28D 1/02

[52] U.S. Cl. ..... 165/146; 165/150; 165/152

[58] Field of Search ..... 165/150, 151, 152, 153, 165/146; 29/157.3 A, 157.3 B

[56] References Cited

U.S. PATENT DOCUMENTS

| | | | |
|---|---|---|---|
| 1,862,219 | 6/1932 | Harrison | 165/152 |
| 3,250,324 | 5/1966 | Hicks | 165/151 |
| 3,438,433 | 4/1969 | Gunter | 165/151 |
| 4,328,861 | 5/1982 | Cheong et al. | 165/153 X |
| 4,350,025 | 9/1982 | Izumi | 62/285 |
| 4,353,224 | 10/1982 | Nonogaki et al. | 165/110 X |
| 4,469,168 | 9/1984 | Itoh et al. | 165/153 X |

*Primary Examiner*—Albert W. Davis, Jr.
*Assistant Examiner*—Richard R. Cole
*Attorney, Agent, or Firm*—Hopgood, Calimafde, Kalil, Blaustein & Judlowe

[57] ABSTRACT

In a corrugated fin unit assembled to a serpentine-anfractuous refrigerant pipe in a serpentine-type heat exchanger, each of generally parallel fin plate portions of the fin unit has a group of louvers parallel to the fin plate portion in the windward region and another group of louvers inclined downwardly in the leeward region, to thereby reduce air flow resistance of each fin unit without substantial reduction of heat exchange rate of the heat exchanger.

5 Claims, 7 Drawing Figures

SERPENTINE-TYPE HEAT EXCHANGER HAVING FIN PLATES WITH LOUVERS

BACKGROUND OF THE INVENTION

1. Field of the Invention

The present invention relates to serpentine-type heat exchangers, and in particular, to louvers of fin plates of such heat exchangers.

2. Description of the Prior Art

Heat exchangers of the serpentine-type have been used for, for example, a refrigerant evaporator in an automotive air conditioning system, as shown in, for example, U.S. Pat. Nos. 4,350,025 and 4,353,224.

The serpentine-type heat exchanger comprises a flat metal tube having a refrigerant passageway or parallel passageways therein extending in a longitudinal direction of the tube. The flat tube is bent to weave up and down, or formed in a serpentine-anfractuous shape, and therefore, has a plurality of parallel portions spaced apart from one another and a plurality of U-shaped curved portions connecting adjacent ones of the parallel portions, respectively. A plurality of corrugated fin units are disposed in spaces between adjacent ones of the parallel portions of the tube and are joined thereto by brazing. Each of the corrugated fin units is formed by bending a thin plate in a corrugated form so that a number of generally parallel fin plate portions extend with gaps from one another while a number of crests are formed in opposte side surfaces of the unit alternately. The crests in the opposite sides of the unit are joined by brazing to flat side surfaces of the opposite parallel portions of the tube.

The heat exchanger is usually used together with a suitable air-flow inducing means such as a fan, blower or the like to establish a continuous flow of air from one side to the other of the heat exchanger through the gaps of each of the fin units disposed in the spaces between adjacent parallel portions of the flat tube.

Since the flat tube and each of the fin units are cooled by refrigerant flowing in the flat tube, air is cooled by heat exchange during passing through gaps in each of the fin units.

In order to improve heat exchange rate, each fin plate portion has louvers fir disturbing and deflecting air flows passing through fin units, as disclosed in, for example, U.S. Pat. No. 4,353,224.

In a known arrangement, several groups of louvers are inclined in an opposite direction to other groups of louvers so that air generally flows along a wave-like course in the fin unit. In the arrangement, since the air flow direction is deflected a number of times, air flow resistance is disadvantageously large. On the other hand, moisture in the air alow condenses on the fin plate portion, and the condensed water is carried by the wave-like air flow and is undesirably splashed outside of the heat exchanger from the air flow output end of the heat exchanger.

SUMMARY OF THE INVENTION

It is an object of the present invention to provide a serpentine-type heat exchanger having fin units with louvers wherein air flow resistance is reduced with a high heat exchange rate.

It is another object of the present invention to provide a serpentine-type heat exchanger having fin units with louvers wherein water condensed on fin plates is not almost carried by the air flow but easily flows down in the heat exchanger to be drained from the bottom of the heat exchanger.

As described above, a serpentine-type heat exchanger comprises a flat metal tube formed in a serpentine-anfractous shape, and a plurality of fin units joined to the flat metal tube, each fin unit having a plurality of parallel fin plate portions, each fin plate portion having a plurality of louvers for disturbing air flow passing from one side to the other side of the heat exchanger.

In the present invention, each fin plate portion is provided with a first group of louvers in a windward region thereof and a second group of louvers in a leeward region thereof. The first group of louvers are substantially parallel to the fin plate portion and the second group of louvers are all inclined in the same direction.

According to the invention, since the louvers of the first group are parallel to the fin plate portion, they are also parallel to the air flow direction in the gap between adjacent fin plate portions so that air flow resistance is reduced. Furthermore, since the louvers of the second group are inclined downwards, water condensed on the fin plate portion easily drops down to the lower fin plate portion so that the condensed water can be drained at the bottom of the heat exchanger.

Further objects, features and other aspects of the present invention will be understood from the following detailed description of preferred embodiments of the present invention referring to the accompanying drawings.

DETAILED DESCRIPTION OF PREFERRED EMBODIMENTS

Figure 1:
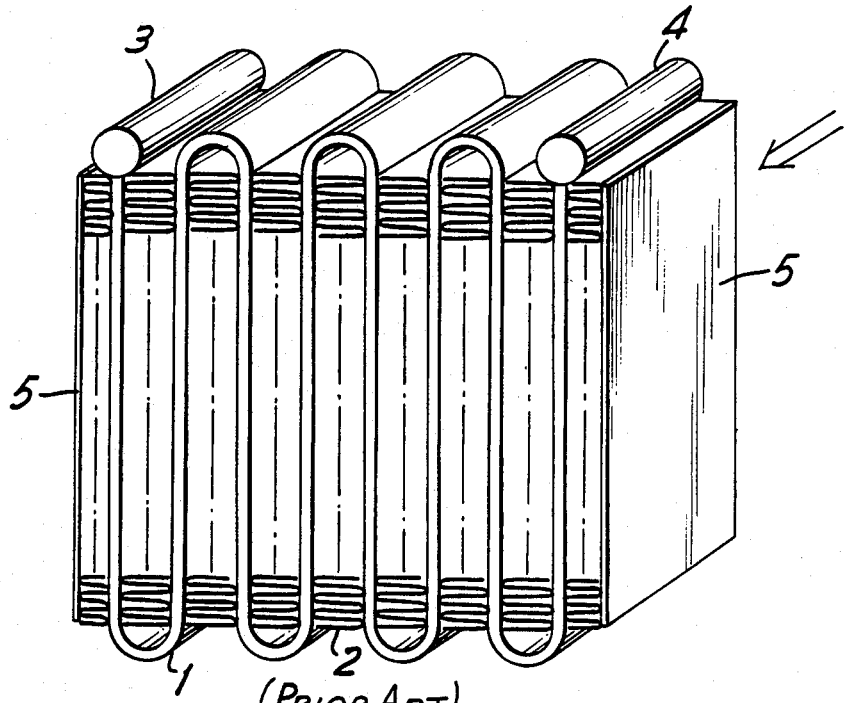
(PRIOR ART) FIG. 1
FIG. 1 is a perspective view of a typical heat exchanger of a serpentine type.
Figure 2:
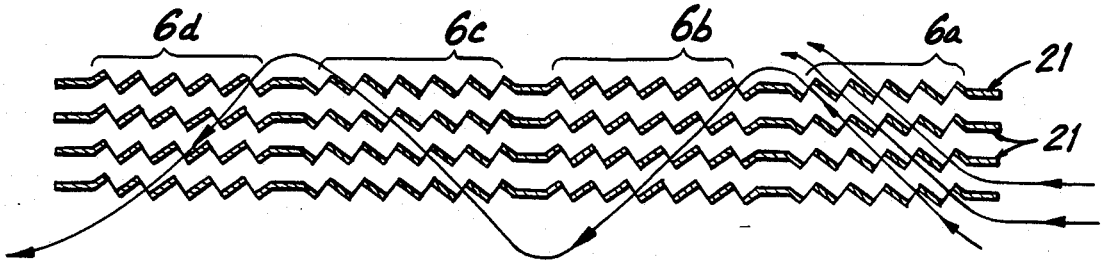
(PRIOR ART) FIG. 2
FIG. 2 is a sectional view of a fin unit in the heat exchanger for illustrating a known louver arrangement.

Prior to description of embodiments of the present invention, a known heat exchanger is described referring to FIGS. 1 and 2.

Referring to FIG. 1, a typical serpentine-type heat exchanger comprises a flat metal tube 1 which has one or more refrigerant passageways therein and is formed in a serpentine-anfractuous shape, as described hereinbefore. A plurality of corrugated fin units 2 are disposed in spaces between adjacent ones of parallel portions of serpentine-anfractuous flat metal tube 1 and joined thereto.

An inlet header pipe 3 is mounted on an end of flat tube 1 to introduce refrigerant fed through a refrigerant feeder pipe (not shown) to the refrigerant passageways of the flat tube. Flat tube 1 has an outlet header pipe 4 on the other end thereof to lead the refrigerant passing through the flat tube into a refrigerant return pipe (not shown).

The heat exchanger has protective side plates 5 for protecting corrugated fin units 2 at opposite sides of the heat exchanger.

As described above, the heat exchanger is used together with, for example, a blower (not shown) to generate air flow passing the fin units 2 from one side to the other side of the exchanger, as indicated by the broad arrow. Since flat tube 1 and fin units 2 are cooled by refrigerant flowing in the flat tube, air is cooled by heat exchange during flowing in the fin units.

In order to improve the heat exchange rate, louvers are provided to each fin plate portion of each fin unit, as described above.

Referring to FIG. 2, fin unit 2 has a plurality of fin plate portions 21 which generally extend in parallel with one anther from an air inlet end (right side in the drawing) to an air outlet end (left side in the drawing), as described above. The parallel fin plate portions 21 have gaps between adjacent ones, through which air flows. Each fin plate portion 21 is provided with louvers to disturb the air flow.

In a known louver arrangement, a first group of louvers 6*a* in a region adjacent the air input end are inclined in a direction to guide air flow upwardly. A second group of louvers 6*b* subsequent thereto is inclined in an opposite direction to pilot air flow downwardly. The next group of louvers 6*c* are inclined in the same direction as the first group louvers 6*a*, and the final group of louvers 6*d* are inclined in the same direction as the second group louvers 6*b*.

Each louver is formed by cutting a portion of the fin plate portion 21 and raising the cut portion, for example, by the use of a louvering die and punch.

In the known arrangement, air generally flows along a wave-like course as indicated by arrows in FIG. 2. In the case, there are some disadvantages problems as described above.

The present invention attempts to improve louver arrangement so as to resolve those problems.

Figure 3:
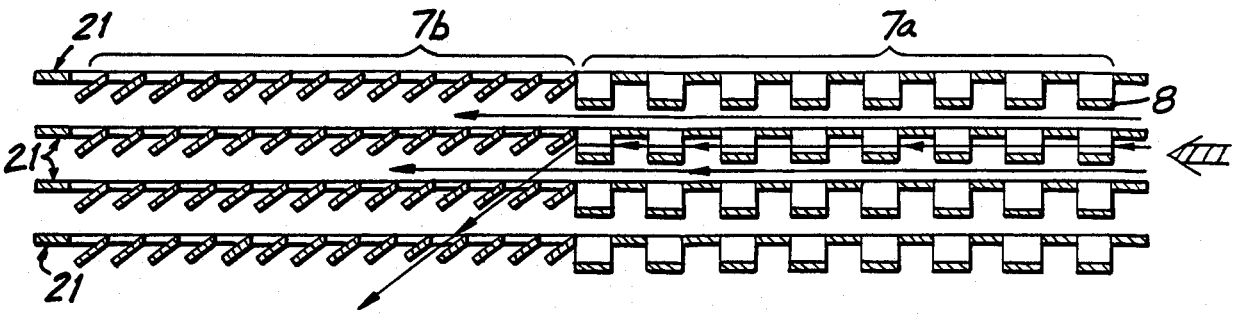
FIG. 3 is a sectional view of a fin unit in an embodiment according to the present invention.
Figure 4:
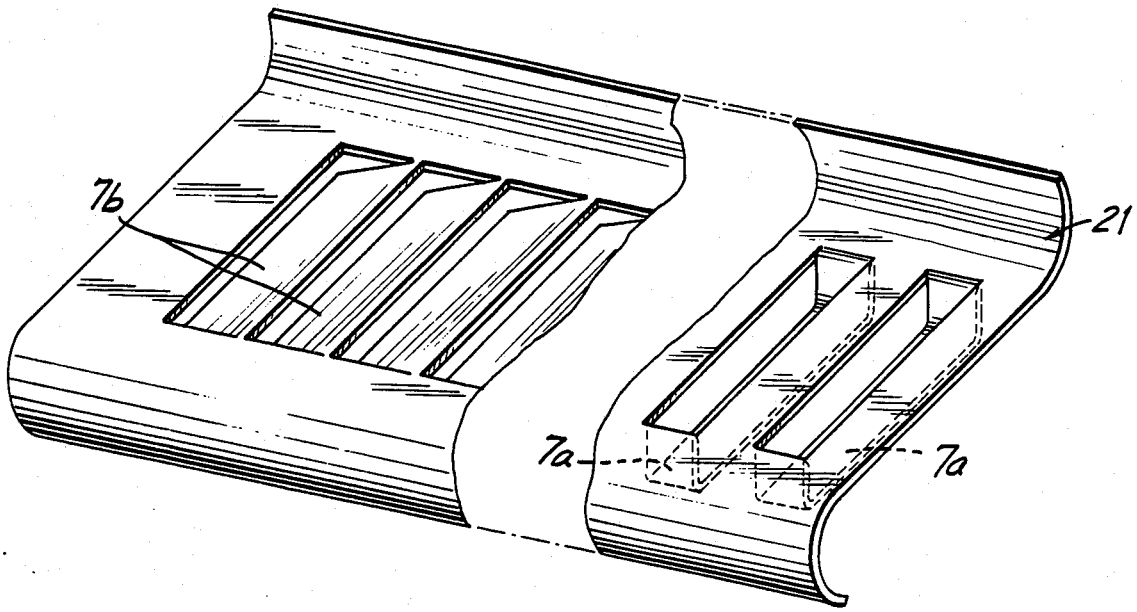
FIG. 4 is a perspective view of a fin plate portion in FIG. 3.

Referring to FIGS. 3 and 4, each fin unit 2 of an embodiment shown therein also has a plurality of parllel fin plate portions 21 with gaps therebetween.

Each fin plate portion 21 has two groups of louvers 7*a* and 7*b*. One group, louvers 7*a*, are provided in a region adjacent the air input end, or a windward region, while the other group, louvers 7*b*, are in a leeward region. Louvers 7*a* are parallel to fin plate 21 and therefore, to air flow introduced through the air input end. Louvers 7*b* are inclined downwardly.

Figure 5:
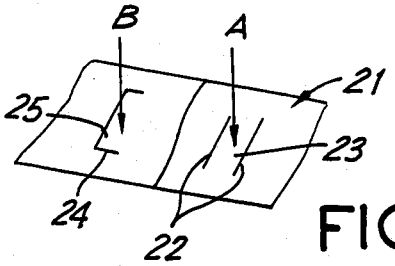
FIG. 5 is a partial perspective view of a fin plate portion prior to formation of louvers.

Referring to FIG. 5, each parallel louver 7*a* is formed by cutting a pair of slits 22 in fin plate portion 21 and drawing a portion 23 between the paired slits in a direction as indicated by arrow A in FIG. 5. Each inclined louver 7*b* is formed by cutting a U-shaped slit 24 in fin plate 21 and raising a portion 25 surrounded by the U-shaped slit from the surface of the fin plate in a direction. as indicated by arrow B in FIG. 5. Thus, parallel louvers 7*a* and inclined louvers 7*b* are disposed on the bottom side surface of fin plate 21.

Referring to FIG. 3, since louvers 7*a* are parallel to the air flow in the windward region, air flows along fin plate portions 21 in the fin unit 2 smoothly so that the air flow resistance is small. After passing through the parallel louver region, the air is partially guided downwardly by inclinded louvers 7*b*, as indicated by thin arrows.

In the louver arrangement, any upward air flow is not caused. Therefore, water condensed on fin plate portions 21 and flat tube 1 partially flows downwardly and is partially carried downwardly in fin unit 2. Thus, the water is not almost splashed from the air output end by air flowing out therethrough, but is collected at the bottom of the heat exchanger and can be drained.

In the windward region, since louvers 7*a*are parallel to the air flow, the air flow is not disturbed to any great extent so that the heat exchange rate is lowered. However, air flow collides with windward edge 8 of each parallel louver 7*a* and, therefore, is disturbed sufficiently that a higher heat exchange rate is obtained in comparion with the case in which no louver is provided.

Since the temperature difference between air and refrigerant gas in the windward region is quite large, air is sufficiently cooled in the windward region with the lowered heat exchange rate. The cooled air is further cooled in the leeward region having a higher heat exchange rate. Accordingly, the overall heat exchange rate of the heat exchanger is not reduced by the use of parallel louvers 7*a*. That is, all of the refrigerant flowing through flat tube 1 effects to cool air passing through the heat exchanger not only in the windward region but also in the leeward region.

Figure 6:
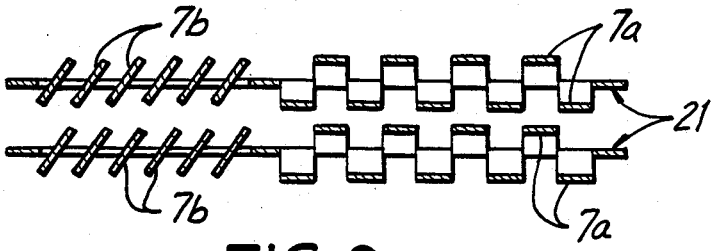
FIG. 6 is a sectional view similar of FIG. 3. but illustrating another embodiment of the present invention.

Referring to FIG. 6, parallel louvers 7*a* are formed on opposite sides of each fin plate 21. Inclined louvers 7*b* are formed to project not only downwardly but also upwardly to guide air flow on the fin plate downwardly.

In the arrangement of FIG. 6, it will be understood that the air flow resistance is reduced in comparison with the prior art without degradation of the overall heat exchanger rate of the heat exchanger. Condensed water is not almost splashed outside by outgoing air flow but can be drained from the bottom of the heat exchanger.

Figure 7:
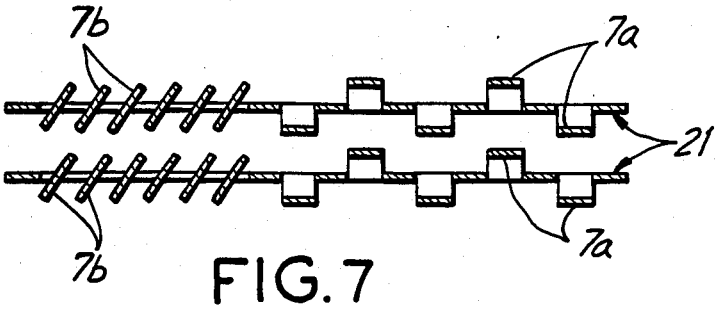
FIG. 7 is a sectional view illustrating still another embodiment.

Referring to FIG. 7, a modification shown therein is similar to the embodiment of FIG. 6 except that adjacent parallel louvers are spaced from one another in the air flow direction. Functions of louvers 7*a* and 7*b* are similar to those of the embodiment of FIG. 6. Further description will not be necessary.

What is claimed is:

1. In a heat exchanger of a serpentine type comprising a flat metal tube with side edges which tube is provided with at least one fluid passageway therein and is formed longitudinally in a serpentine-anfractuous shape so as to have a plurality of parallel portions that are spaced apart from one another extending between said side edges and constructed for use with said parallel portions and said side edges oriented vertically, and a plurality of metal fin units fixedly disposed within the spaces between adjacent ones of said parallel flat tube portions, each of said fin units having a plurality of fin plate portions which extend transverse to the longitudinal direction of said flat tube from one said side edge to the other side edge generally parallel with one another, said plurality of fin plate portions having gaps therebetween through which air can flow from said one side edge to said other side edge for heat exchange, each of said fin plate portions being provided with louvers for controlling air flow directions through each fin unit, the improvement wherein each of said fin plate portions is provided within the space bounded by said flat tube parallel portions and side edges with a first and second group of louvers located, respectively, closer to said one and said other side edge, said first group of louvers having respective surface areas positioned substantially parallel to but offset from the plane of said fin plate portions, and said second group of louvers having respective surface areas inclined relative to said fin plate portions for downward orientation when the heat exchanger is in use, whereby air flowing through said fin units from said one edge to said other side passes successively through said first and second group of louvers.

2. The heat exchanger as claimed in claim 1, wherein each of said louvers of said first group is defined by two parallel slits in said fin plate portions and a drawn portion between said parallel slits.

3. The heat exchanger as claimed in claim 1, wherein each of said louvers of said second group is defined by a U-shaped slit in said fin plate portions and a raised portion surrounded by said U-shaped slit.

4. The heat exchanger as claimed in claim 1, wherein said first and second groups of louvers are provided projecting all from one and the same side of said fin plate portions.

5. The heat exchanger as claimed in claim 1, wherein said louvers of said first group are provided projecting alternately from opposite sides of sad fin plate portions, and said louvers of said second group project from both sides of said fin plate portions.

* * * * *

UNITED STATES PATENT AND TRADEMARK OFFICE

CERTIFICATE OF CORRECTION

PATENT NO. : 4,676,304

DATED : June 30, 1987

INVENTOR(S) : Mikio Koisuka and Hisao Aoki

It is certified that error appears in the above-identified patent and that said Letters Patent are hereby corrected as shown below:

In column 5, line 9, before "edge" should be inserted --side--;

same line, before "passes" should be inserted --edge--;

Column 6, line 11, "sad" should read --said--.

Signed and Sealed this

Third Day of November, 1987

*Attest:*

DONALD J. QUIGG

*Attesting Officer*

*Commissioner of Patents and Trademarks*